United States Patent [19]

Foster

[11] Patent Number: 4,621,744

[45] Date of Patent: Nov. 11, 1986

[54] TAMPER-EVIDENT CONTAINER CLOSURE

[75] Inventor: John A. Foster, Rockford, Ill.

[73] Assignee: J. L. Clark Manufacturing Co., Rockford, Ill.

[21] Appl. No.: 816,323

[22] Filed: Jan. 6, 1986

[51] Int. Cl.[4] ..... B65D 17/34

[52] U.S. Cl. ..... 220/270; 220/339; 220/307; 220/214; 222/153

[58] Field of Search ..... 220/266, 270, 307, 339, 220/214; 222/153, 541

[56] References Cited

U.S. PATENT DOCUMENTS

| | | | |
|---|---|---|---|
| 3,131,824 | 5/1964 | Van Baarn | 215/41 |
| 3,155,285 | 11/1964 | Van Baarn | 222/153 |
| 4,280,636 | 7/1981 | Lewis | 220/307 |
| 4,361,250 | 11/1982 | Foster | 220/266 |
| 4,462,504 | 7/1984 | Roth et al. | 220/214 |
| 4,463,869 | 8/1984 | Lewis | 220/270 |
| 4,487,324 | 12/1984 | Ostrowsky | 215/253 |
| 4,519,517 | 5/1985 | Walter | 220/339 |

*Primary Examiner*—George T. Hall

*Attorney, Agent, or Firm*—Leydig, Voit & Mayer, Ltd.

[57] ABSTRACT

Three hinged flaps of a plastic container closure are molded while in open positions and, during molding of the flaps, an elongated tear-away strip is formed along the front edges of the flaps and is integrally connected to the flaps by tearable webs. After the newly molded flaps have first been closed, the strip is anchored releasably to the top panel of the closure and prevents the flaps from opening during shipment of the container, the strip also serving as a visual indicator that the seal of the closure is intact. The closure is opened by lifting and pulling on the strip to tear the latter completely away from the top panel and the flaps and to free the flaps for swinging to open positions. The absence of the strip or the presence of a partially torn strip indicates that tampering has occurred and that the seal may not be intact.

11 Claims, 10 Drawing Figures

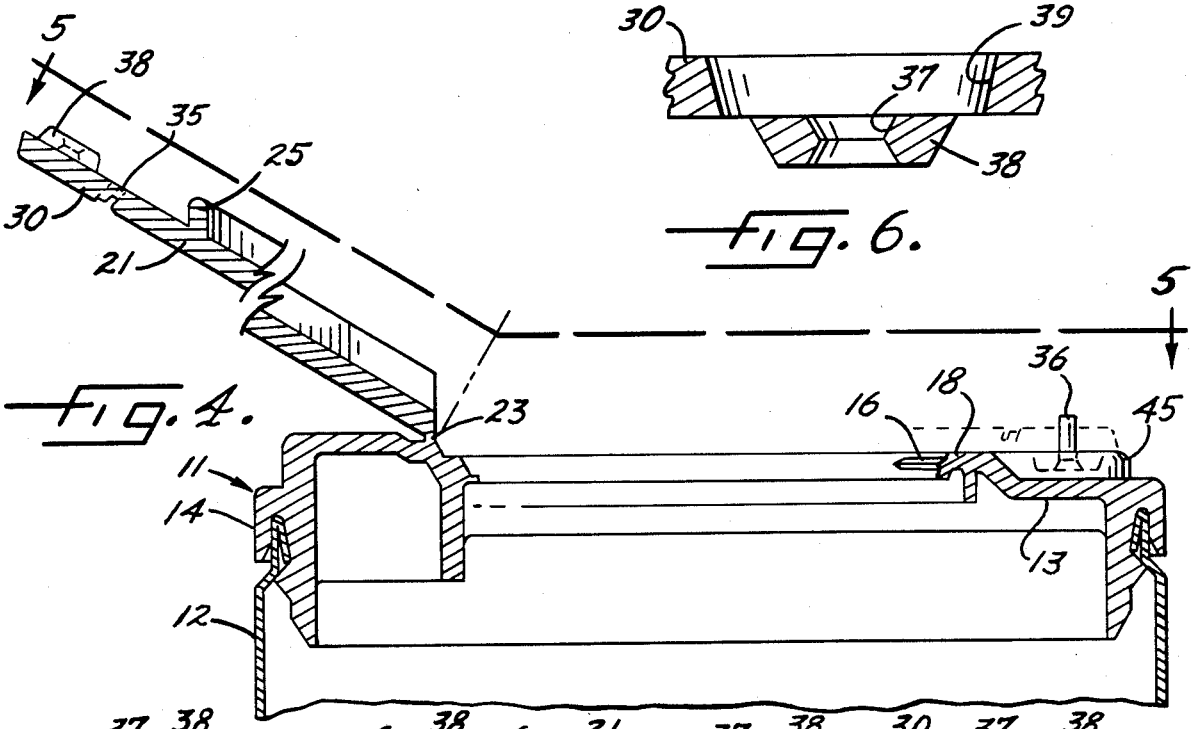
Fig. 4.
Fig. 6.
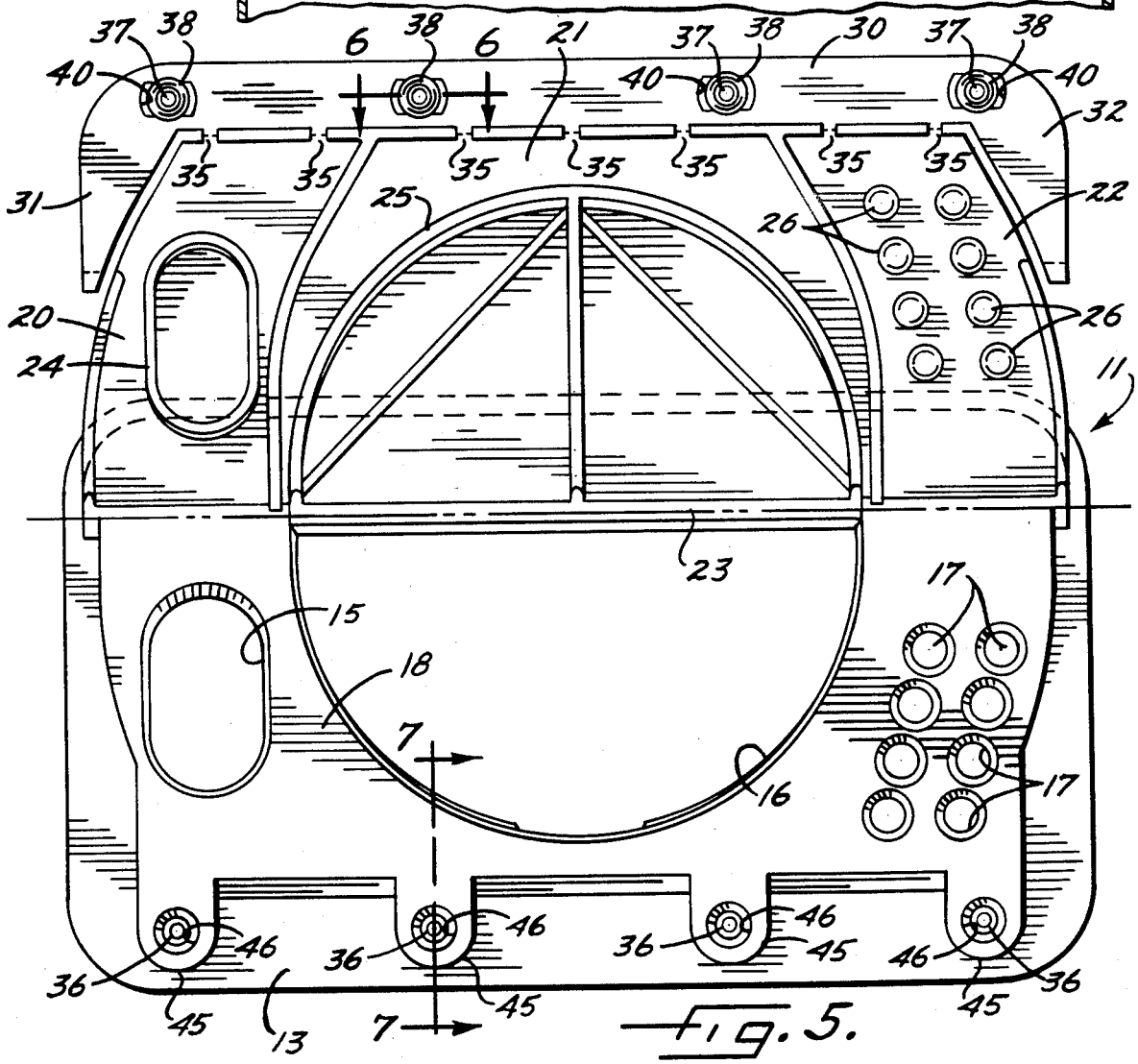
Fig. 5.

TAMPER-EVIDENT CONTAINER CLOSURE

BACKGROUND OF THE INVENTION

This invention relates to a container closure of the type in which at least one flap is integrally hinged to the top panel of the closure and is adapted to be swung upwardly and downwardly to open and close a dispensing opening which is formed through the top panel. More specifically, the invention relates to a closure of the type in which means hold the flap securely in its closed position until the container is first opened and, at the same time, provide a visual indication as to whether the container has been tampered with and opened prior to purchase by the consumer. Such a closure is commonly referred to as being a tamper-evident closure.

A closure of this general type is disclosed in Foster U.S. Pat. No. 4,361,250. In that closure, plastic strips extend alongside opposite side edges of the flap and are connected to the flap by tearable webs, the strips being anchored permanently to the top panel of the closure. Before the flap is initially swung upwardly, the strips and the webs coact to hold the flap closed and to prevent accidental opening of the flap during shipment of the container. When a substantial manual lifting force is applied to the flap, the webs tear to permit the flap to separate from the rigidly anchored strips and to permit the flap to swing open. The torn web portions which remain on the strips and the side edges of the flap provide visual evidence that the container has been opened and that the original seal is no longer intact.

One of the problems with the closure disclosed in the Foster patent is that the torn webs are very small and thus only an astute observer is able to detect tampering. In addition, the unopened closure does not give the outward appearance of being a tamper-evident closure and thus a well-intentioned consumer may in good faith attempt to open the flap without realizing that he might destroy the integrity and the future saleability of the container. Moreover, the antitamper arrangement of the Foster patent does not readily lend itself to use with a closure with multiple side-by-side closure flaps.

SUMMARY OF THE INVENTION

The general aim of the present invention is to provide a new and improved tamper-evident closure of the above general type having a single tear-away strip whose presence provides a clear indication that the closure is of the tamper-evident type and whose absence gives a clear indication that tampering has occurred, the single tear strip being capable of holding multiple closure flaps in their originally closed and sealed positions.

A more detailed object of the invention is to achieve the foregoing by providing a closure in which a tear-away strip extends along the front edges of side-by-side closure flaps and is connected to such edges by frangible webs. The tear strip is anchored releasably to the top panel of the closure and normally holds all of the flaps in their closed positions to preserve the integrity of the seal and to provide a clear indication that the container is of the tamper-evident type. By pulling upwardly on one end of the strip, the latter may be torn away from the panel and the flaps to permit opening of the flaps. If the strip is partially torn or is absent, the consumer is warned that the original seal may not be intact.

The invention also resides in the unique means for connecting the tear strip to the closure panel to effect secure anchoring of the strip while permitting relatively easy release of the strip and while enabling the closure to have an aesthetically pleasing appearance.

These and other objects and advantages of the invention will become more apparent from the following detailed description when taken in conjunction with the accompanying drawings.

BRIEF DESCRIPTION OF THE DRAWINGS

FIG. 4 is an enlarged fragmentary cross-section taken substantially along the line 4—4 of FIG. 1 and shows the closure in an open condition after being molded and prior to initial closing of the flaps.

FIG. 5 is a top plan view of the closure as taken substantially along the line 5—5 of FIG. 4.

FIGS. 6, and 7 are enlarged fragmentary cross-sections taken substantially along the lines 6—6 and 7—7, respectively, of FIG. 5.

DETAILED DESCRIPTION OF THE PREFERRED EMBODIMENT

Figure 1:
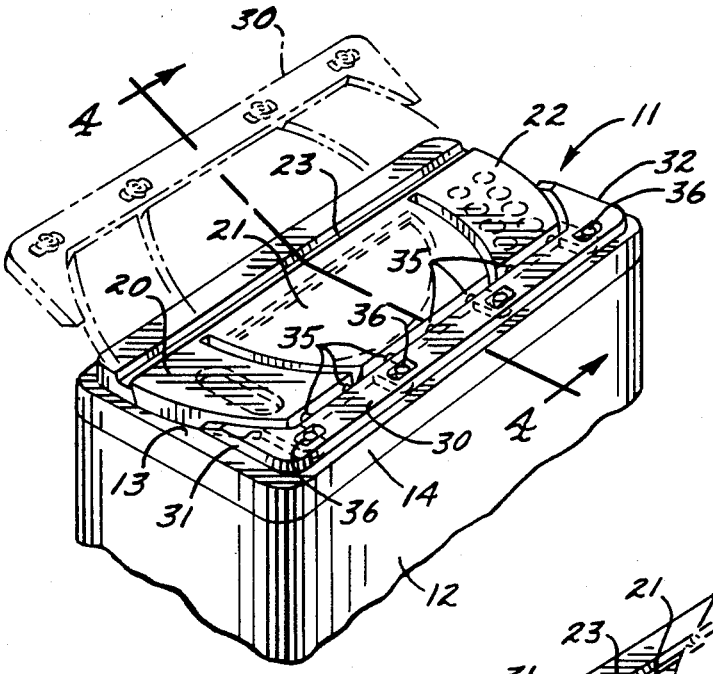
FIG. 1 is a fragmentary perspective view of a container equipped with a new and improved closure incorporating the unique features of the present invention, the closure being shown in its original unopened condition.
Figure 2:
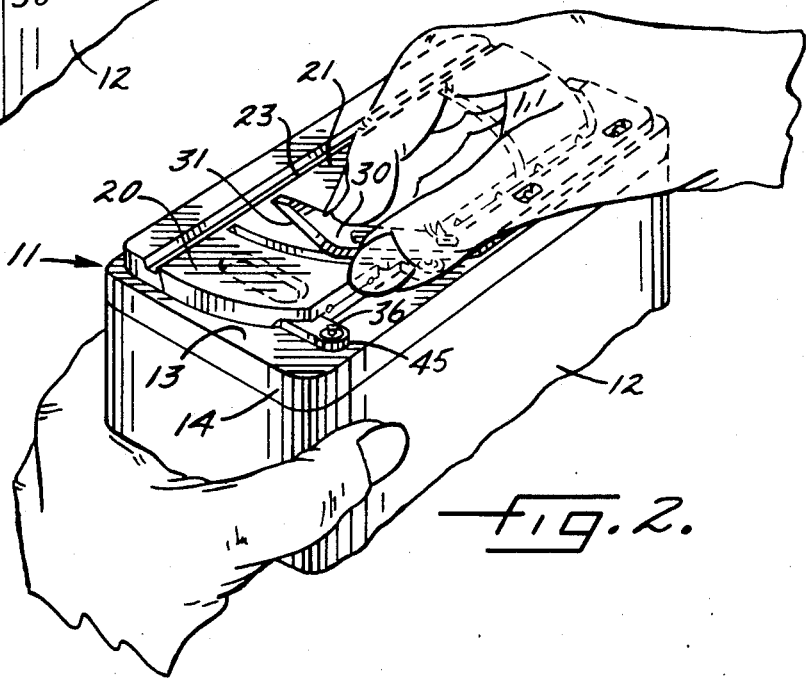
FIG. 2 is a view similar to FIG. 1 but shows the first step of opening the closure.

As shown in the drawings for purposes of illustration, the invention is embodied in a closure 11 for a container such as a metal spice can 12 which, in this instance, is of rectangular cross-section. The closure comprises a generally rectangular cover injection molded from suitable plastic such as polypropylene and defined by a horizontal top panel 13. A skirt 14 is molded integrally with and depends from the top panel adjacent the periphery thereof and telescopes snugly with the upper end portion of the can 12.

Formed through the top panel are one or more dispensing openings which may be of any desired shape. In this instance, there are three side-by-side openings 15, 16 and 17 (FIG. 5). The outboard opening 15 is a rather small oval opening which may be used as a pour opening. The center opening 16 is significantly larger than the pour opening 15, is generally semicircular in shape and defines a spoon opening. As shown in FIG. 5, the outboard opening 17 is actually several small circular holes which form sift holes. In the area immediately surrounding the openings, the panel is formed with a raised platform 18 (FIG. 5). As a result, the panel includes a relieved area around the periphery of the platform so as to enable the bottom of another can to stack with the closure 11.

The openings 15, 16 and 17 are adapted to be closed by side-by-side flaps 20, 21 and 22, respectively. The flaps are molded integrally with the top panel 13 and are swingably connected to the top panel along a hinge line 23 which extends parallel to the front edges of the flaps. As is conventional, the hinge 23 is formed by molding a thin or weakened section of plastic along the junction between the top panel and the flaps. In this instance, the hinge for all three flaps lies along a single continuous line but the side edges of the flaps are spaced from one another and thus the flaps may be independently opened and closed.

Depending ribs 24 and 25 (FIG. 5) having the same shape as the openings 15 and 16, respectively, are molded integrally with the undersides of the flaps 20 and 21 and are adapted to telescope into and seal the openings when the flaps are swung to their closed positions. Similarly, the holes 17 are adapted to be closed and sealed by small circular plugs 26 molded integrally with the underside of the flap 22.

The flaps 20, 21 and 22 are molded while in an inclined position (see FIG. 4) as disclosed substantially in Foster U.S. Pat. No. 3,675,812 and are first closed after the closure 11 has been ejected from the molding dies. In accordance with the present invention, an elongated tear-away strip 30 is molded integrally with the front edges of the flaps, is releasably anchored to the top panel 13 and initially locks the flaps to the panel to hold the flaps in their closed positions. To open the closure 11, the strip 30 is torn away from the panel and the flaps and frees the flaps to swing to their open positions. The presence of the tear strip provides an indication that the closure is of the tamper-resistant type and discourages innocent opening of the closure while the absence of the strip indicates that tampering has occured and that the seal may not be intact.

More specifically, the strip 30 extends parallel to the hinge 23 and is sufficiently long to extend along the entire length of the front edges of all three flaps 20, 21 and 22. The strip is spaced forwardly from the front edges of the flaps by a short distance (e.g., 1/32") and is formed with two integral end tabs 31 and 32 (FIGS. 1 and 5). The tab 31 projects rearwardly from the strip and lies alongside the outboard side edge of the flap 20 while the tab 32 also projects rearwardly and lies alongside the outboard side edge of the flap 22. The strip and the tabs are approximately the same thickness as the front edge portions of the flaps and lie in the same plane as the front edge portions of the flaps.

Figure 10:
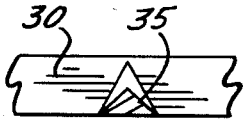
FIG. 10 is a fragmentary cross-section taken substantially along the line 10—10 of FIG. 8.

In keeping with the invention, the strip 30 is connected to the front edges of the flaps 20, 21 and 22 by weakened web means which permit the strip to be torn away from the flaps. Herein, the web means are in the form of seven narrow webs 35 (FIGS. 5, 8 and 10) spaced along the strip and molded integrally with the flaps and the strip so as to extend between the same. Two webs 35 extend between the strip and each of the end flaps 20 and 22 while three webs 35 extend between the strip and the center flap 21. The webs normally hold the flaps and the strip in connected relation but are sufficiently thin and weak to tear and permit the strip to be torn away from the flaps. When the closure 11 is molded, plastic is injected directly into the die cavities for the flaps. The small die cavities which serve to form the webs 35 also act as gates to permit plastic to flow from the flap areas to the strip area and thereby form the strip.

Figure 7:
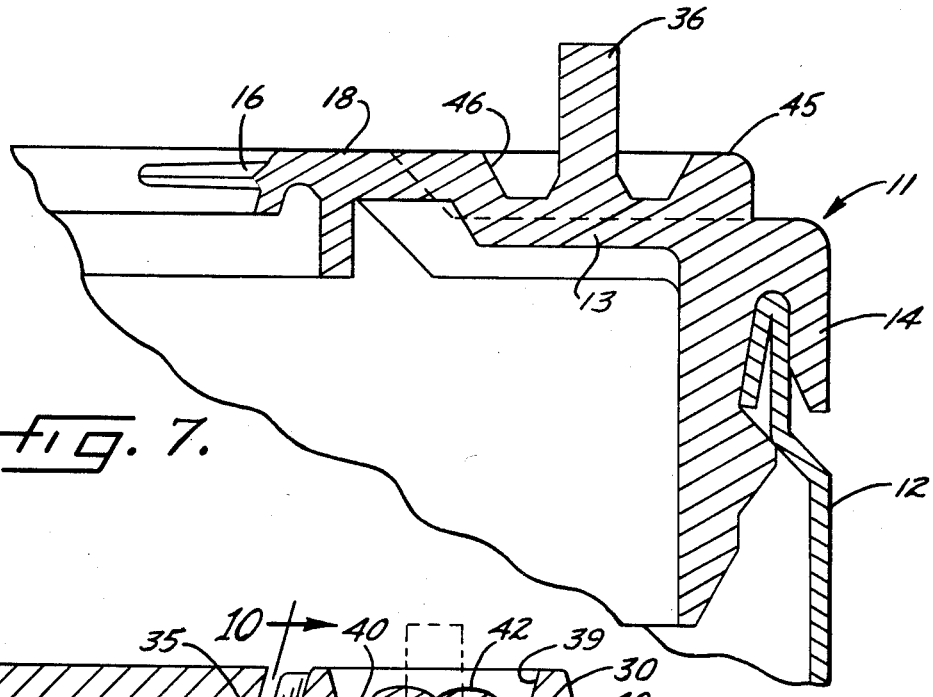

Further in keeping with the invention, means are provided for anchoring the tear strip 30 to the top panel 13 while permitting the strip to be torn away from the panel in a relatively easy manner as an incident to intentional opening of the closure 11. In the preferred embodiment, these means comprise a series (herein, four) of upwardly projecting and generally cylindrical pins 36 (FIGS. 7 to 9) molded integrally with and spaced along the front edge portion of the top panel 13. Such pins extend through circular holes 37 (FIGS. 6 and 8) which preferably are formed within buttons 38. The latter, in turn, are located beneath openings 39 formed in the strip 30 and are connected to the lower edges of the openings by angularly spaced and relatively thin webs 40 (FIG. 8) which permit the buttons to tear away from the edges of the openings. The buttons 38 and the webs 40 are formed integrally with the strip 30 when the strip is molded.

Figure 8:
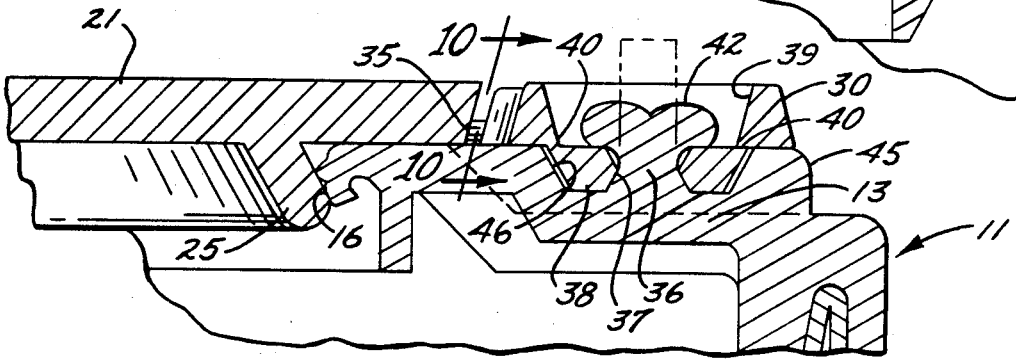
FIG. 8 is a view similar to FIG. 7 but shows the closure with the tear strip intact.
Figure 9:
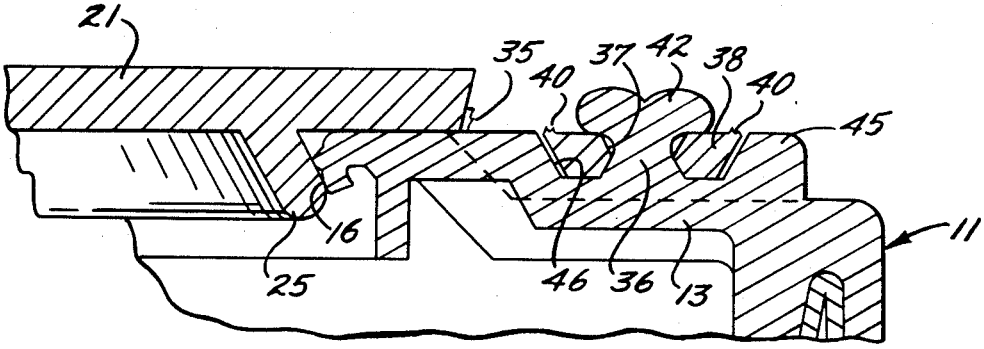
FIG. 9 is also a view similar to FIG. 7 but shows the closure after removal of the tear strip.

After the closure 11 has been molded, the flaps 20, 21 and 22 with the connected strip 30 are swung downwardly to their closed positions. As an incident thereto, the holes 37 in the buttons 38 telescope with the pins 36. Thereafter, enlargements or heads 42 (FIGS. 8 and 9) are formed on the upper end portions of the pins by subjecting the pins to a heat staking operation to cause the upper ends of the pins to mushroom over. The mushroom-shaped heads 42 engage the upper sides of the buttons 38 as shown in FIGS. 8 and 9 and captivate the strip downwardly against the panel 13 so as to lock the flaps 20, 21 and 22 in their closed positions.

When the strip 30 is properly in place on the closure 11, the strip serves as a clear indicator that the closure is of the tamper-evident type and thus well-meaning potential purchasers are warned against innocently attempting to open the closure while the container 12 is on a retail shelf. The closure may be opened by the purchaser by grasping either of the tabs 31 and 32 and by lifting upwardly on the strip while pulling the strip along the length of the panel. As a result of such lifting and pulling, the strip tears away from the captivated buttons 38 as permitted by the thin webs 40 and, at the same time, the strip tears away from the flaps 20, 21 and 22 as permitted by the thin webs 35. Accordingly, the strip 30 is completely separated from the closure 11 and may be thrown away. Once the strip has been removed, the flaps are no longer tied to the panel 13 and thus may be freely opened.

If the strip 30 is partially torn or completely removed while the container 12 is on the shelf, the container will appear significantly different from neighboring containers and thus the customer will be warned that tampering has occurred. In addition, the exposed buttons 38 and the torn webs 35 and 40 provide visual evidence of tampering.

Figure 3:
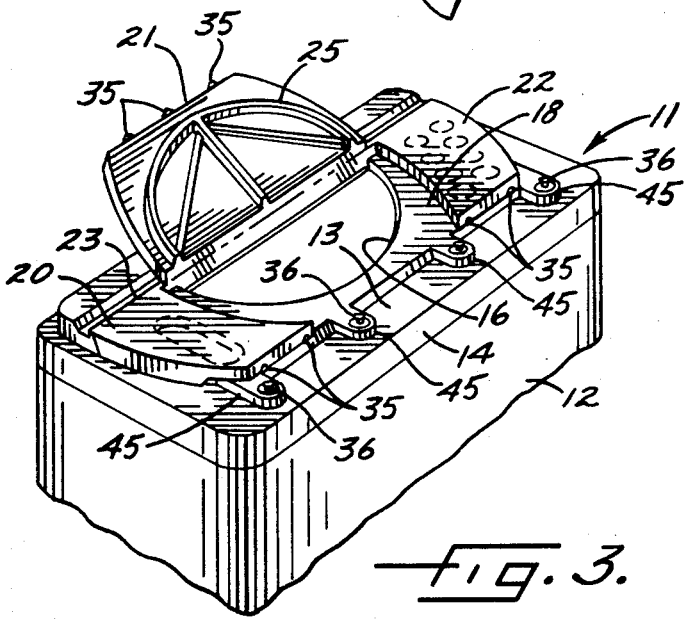
FIG. 3 also is a view similar to FIG. 1 but shows one of the flaps of the closure in an open position.

The closure 11 is constructed so as to be aesthetically attractive. Thus, the tear strip 30 is flush with the upper sides of the flaps 20, 21 and 22 and is disposed entirely within the confines of the periphery of the top panel 13 so as to not interfere with the stacking capability of the container. By virtue of the buttons 38 being located beneath the openings 39 in the strip 30, the upper sides of the buttons are located well below the upper side of the strip and thus the pins 36 may extend through the holes 37 in the buttons and into the openings 39 in the strip without projecting upwardly beyond the upper side of the strip. To enable easy access to the strip and the lift tabs 31 and 32, the strip is spaced upwardly from the panel 13 by four tongues 45 (FIGS. 3 and 5) disposed in the same plane as the platform 18 and extending at the locations of the pins. The tongues support the strip against downward flexing and yet keep each lift tab spaced above the panel 13 so that a thumb nail may be placed beneath the tab when the latter is first lifted. Each tongue is formed with a pocket 46 which surrounds the pin 36 and which receives the button 38 (see FIGS. 8 and 9). As a result of being received in the pockets 46, the buttons do not cause the upper side of the strip 30 to project above the upper sides of the flaps.

Those skilled in the art will appreciate that the pins 36 could project through simple holes in the strip and that the heads 42 of the pins could be torn away from the pins to free the strip when the latter is lifted and pulled. The use of the buttons 38, however, insures an easier and more reliable release of the strip. It will also be appreciated that the strip could be formed with depending pins which extend through holes in the panel and which either tear away from the strip or have heads which shear off when the strip is lifted and pulled.

From the foregoing, it will be apparent that the present invention brings to the art a new and improved closure 11 in which a single strip 30 serves to hold three flaps 20, 21 and 22 in locked and sealed positions prior to initial opening of the container. Both the presence and absence of the strip are clearly apparent and, in addition, the strip is not detrimental to the appearance of the closure or to the ability of the closure to stack with another container.

I claim:

1. A container closure comprising a top panel piece molded of plastic, a dispensing opening formed through said panel piece, a flap molded integrally with said panel piece along a hinge line and swingable upwardly and downwardly about said hinge line and relative to said panel piece between open and closed positions with respect to said dispensing opening, said flap having a front edge extending generally parallel to said hinge line, an elongated plastic strip piece extending alongside and spaced forwardly from the front edge of said flap and overlying said panel piece when said flap is in said closed position, tearable webs molded integrally with and spaced along said strip piece and the front edge of said flap and extending between the two, upright openings formed through one of said pieces, upright plastic pins molded integrally with the other of said pieces and extending into said openings, and means on said pins for normally holding said strip piece and said flap downwardly against said panel piece but sufficiently weak to tear in response to an upwardly lifting force being applied to one end portion of said strip piece whereby said strip piece may be lifted upwardly from said panel piece and torn away from the front edge of said flap at said webs thereby to enable the flap to be swung upwardly to its open position.

2. A container closure as defined in claim 1 in which said holes are formed in said strip piece and in which said pins are formed integrally with and project upwardly from said panel piece.

3. A container closure as defined in claim 2 in which said means comprise buttons disposed within said openings and having holes receiving said pins, thin webs connecting the outer peripheries of said buttons to the edges of said holes and permitting said buttons to be torn away from said edges, and enlargements on the upper ends of said pins and engaging the upper sides of said buttons to hold said strip piece and said flap downwardly against said panel piece.

4. A container closure as defined in claim 3 in which the upper sides of said buttons are disposed below the upper side of said strip piece, the upper ends of the enlargements on said pins being located no higher than the upper side of said strip piece.

5. A container closure as defined in claim 1 in which said panel piece is formed with an additional dispensing opening disposed in side-by-side relation with said one dispensing opening, an additional flap molded integrally with and hinged to said panel piece and swingable upwardly and downwardly relative to said panel piece between open and closed positions with respect to said second dispensing opening, said strip piece extending alongside and being spaced forwardly from the free edge of said additional flap, and tearable webs molded integrally with and spaced along said strip piece and the front edge of said additional flap and extending between the two.

6. A container closure comprising a top panel molded of plastic, a plurality of dispensing openings formed through said panel and disposed in side-by-side relation, a plurality of side-by-side flaps molded integrally with said panel along a hinge line and independently swingable upwardly and downwardly about said hinge line and relative to said panel between open and closed positions with respect to said dispensing openings, each of said flaps having a front edge extending generally parallel to said hinge line, an elongated plastic strip extending alongside and spaced forwardly from the front edges of said flaps and overlying said panel when said flaps are in said closed positions, tearable web means molded integrally with said strip and the front edges of said flaps and extending between the two, and means acting between said strip and said panel for normally holding said strip and said flaps downwardly against the upper side of said panel but releasable in response to an upward lifting force applied to said strip whereby said strip may be lifted upwardly from said panel and torn away from the front edges of said flaps at said web means thereby to free the flaps for upward swinging to their open positions.

7. A container closure as defined in claim 6 further including a lift tab formed integrally with and projecting rearwardly from one end of said strip and located alongside the outboard edge of one of said flaps.

8. A container closure as defined in claim 7 further including an additional lift tab formed integrally with and projecting rearwardly from the other end of said strip and located alongside the outboard edge of another one of said flaps.

9. A container closure as defined in claim 8 in which said strip and said tabs are located within the confines of the periphery of said panel.

10. A container closure comprising a top panel molded of plastic, a plurality of dispensing openings formed through said panel and disposed in side-by-side relation, a plurality of side-by-side flaps molded integrally with said panel along a hinge line and independently swingable upwardly and downwardly about said hinge line and relative to said panel between open and closed positions with respect to said dispensing openings, each of said flaps having a front edge extending generally parallel to said hinge line, an elongated plastic strip extending alongside and spaced forwardly from the front edges of said flaps, said strip being disposed in the plane of said flaps and overlying said panel when said flaps are in said closed positions, tearable webs molded integrally with and spaced along said strip and the front edges of said flaps and extending between the two, vertically extending openings formed through and spaced along said strip, upright plastic pins molded integrally with said panel and projecting upwardly into said vertically extending openings, and means on said pins for normally holding said strip and said flaps downwardly against said panel but sufficiently weak to tear in response to an upward lifting force being applied to one end portion of said strip whereby said strip may be lifted upwardly and torn away from said panel and from the front edges of said flaps at said webs thereby to free the flaps for upward swinging to their open positions.

11. A container closure as defined in claim 10 in which said means comprise buttons disposed within said openings and having holes receiving said pins, thin webs connecting the outer peripheries of said buttons to the edges of said holes and permitting said buttons to be torn away from said edges, and enlargements on the upper ends of said pins and engaging the upper sides of said buttons to hold said strip piece and said flap downwardly against said panel piece.

* * * * *